US009589756B2

(12) United States Patent
Saimoto et al.

(10) Patent No.: US 9,589,756 B2
(45) Date of Patent: Mar. 7, 2017

(54) FUSIBLE LINK MOUNTING STRUCTURE AND ELECTRICAL JUNCTION BOX

(71) Applicant: Yazaki Corporation, Tokyo (JP)

(72) Inventors: Tetsuro Saimoto, Kosai (JP); Takafumi Toda, Kosai (JP); Takeyuki Hamaguchi, Kosai (JP)

(73) Assignee: YAZAKI CORPORATION, Tokyo (JP)

( * ) Notice: Subject to any disclaimer, the term of this patent is extended or adjusted under 35 U.S.C. 154(b) by 316 days.

(21) Appl. No.: 14/036,616

(22) Filed: Sep. 25, 2013

(65) Prior Publication Data

US 2014/0022046 A1 Jan. 23, 2014

Related U.S. Application Data

(63) Continuation of application No. PCT/JP2012/064252, filed on May 25, 2012.

(30) Foreign Application Priority Data

May 26, 2011 (JP) ..... 2011-117845

(51) Int. Cl.
*H01H 85/20* (2006.01)
*H01H 85/22* (2006.01)

(52) U.S. Cl.
CPC ..... *H01H 85/22* (2013.01); *H01H 85/20* (2013.01); *H01H 85/2035* (2013.01);
(Continued)

(58) Field of Classification Search
CPC ..... H01H 85/20; H01H 85/2035; H01H 85/2045; H01H 85/22; H01H 2085/2065; H01H 2085/208; H01H 2085/209
(Continued)

(56) References Cited

U.S. PATENT DOCUMENTS 5,841,338 A 11/1998 Yasukuni
5,977,859 A * 11/1999 Kawamura ..... H01H 85/044 29/623
(Continued)

FOREIGN PATENT DOCUMENTS

CN 101789340 A 7/2010
EP 0 829 928 A2 3/1998
(Continued)

OTHER PUBLICATIONS

Communication issued Apr. 15, 2015, by the State IP Office of PR of China, in related Application No. 201280025648.3.
(Continued)

*Primary Examiner* — Anatoly Vortman
*Assistant Examiner* — Jacob Crum
(74) *Attorney, Agent, or Firm* — Sughrue Mion, PLLC

(57) ABSTRACT

A fusible link mounting structure, comprising a three-series fusible link formed by providing three pieces of fuse elements in series within a single common housing, a cavity having a mounting space formed according to a size of the common housing for the three-series fusible link, a plurality of tabs projected from a bottom of the cavity into the mounting space, and a monopole fusible link formed by providing a piece of fuse element in a single monopole housing, wherein a total length of the mounting space is set to be shorter than a sum of lengths of three-pieces of the monopole housings, and the tabs are arranged corresponding to positions of fuse terminals provided in the three-series fusible link, and also arranged at such positions that a plurality of the terminals do not interfere with the monopole housing, when the monopole fusible link is mounted in the cavity.

5 Claims, 12 Drawing Sheets

(52) U.S. Cl.
CPC ... *H01H 85/2045* (2013.01); *H01H 2085/208* (2013.01); *H01H 2085/2065* (2013.01)

(58) Field of Classification Search
USPC ..... 337/188, 216, 255–259, 292
See application file for complete search history.

(56) References Cited

U.S. PATENT DOCUMENTS

| | | | | |
|---|---|---|---|---|
| 6,007,350 | A | 12/1999 | Isshiki | |
| 6,089,918 | A * | 7/2000 | Arakelian | H01H 85/2035 439/620.27 |
| 6,815,841 | B1 * | 11/2004 | Brown | H01H 85/046 307/10.1 |
| 2002/0024414 | A1 | 2/2002 | Sumida et al. | |
| 2004/0192113 | A1 * | 9/2004 | Yamashita | H01R 13/68 439/620.34 |
| 2005/0237147 | A1 * | 10/2005 | Carreras | H01H 85/2045 337/186 |
| 2005/0275499 | A1 * | 12/2005 | Kita | H01H 85/2035 337/186 |
| 2009/0179728 | A1 | 7/2009 | Urrea et al. | |
| 2010/0022134 | A1 | 1/2010 | Kudo et al. | |
| 2010/0190360 | A1 | 7/2010 | Werner et al. | |

FOREIGN PATENT DOCUMENTS

| | | | |
|---|---|---|---|
| EP | 1 182 680 | A1 | 2/2002 |
| JP | 2010-33800 | A | 2/2010 |

OTHER PUBLICATIONS

Search Report dated Aug. 31, 2012 issued in International Application No. PCT/JP2012/064252 (PCT/ISA/210).
Written Opinion dated Aug. 31, 2012 issued in International Application No. PCT/JP2012/064252 (PCT/ISA/237).

* cited by examiner

FUSIBLE LINK MOUNTING STRUCTURE AND ELECTRICAL JUNCTION BOX

BACKGROUND OF THE INVENTION

The present invention relates to a structure for mounting a fusible link in a cavity. Moreover, the invention relates to an electrical junction box employing this structure.

As an electrical appliance to be mounted on a vehicle such as an automobile, an electrical junction box, for example, is exemplified. The electrical junction box is known as a name for generally calling a relay box, a fuse box, a junction block, an electronic control unit box, and so on.

An art related to the electrical junction box is disclosed in the below mentioned Patent Reference 1. According to this disclosed art, it is possible to achieve reduction in size of the electrical junction box in a direction where the fusible link is arranged. The prior art will be briefly described hereunder.

In FIGS. 11A and 11B, reference numeral 101 represents a fusible link having a monopole structure, while reference numeral 102 represents a fuse box in which four pieces of the fusible links 101 can be mounted. The fuse box 102 has four cavities 103 for mounting the four fusible links 101. The four cavities 103 are so formed as to be continued without a partition wall. A pair of terminals 104 in a shape of a tab are projected from a bottom of each of the cavities 103 so that electrical connection may be established, when the fusible links 101 are mounted. Because the partition wall is not provided in the fuse box 102, as described above, a pitch P1 in the arranging direction of the fusible links 101 is equal to a width H1 of a fuse housing for the fusible links 101.

In FIGS. 12A and 12B, a fuse box 105 is so formed that four pieces of the fusible links 101 can be mounted therein. Cavities 106 are partitioned with partition walls 107. A pair of terminals 104 in a shape of a tab are projected from a bottom of each of the cavities 106 so that electrical connection may be established, when the fusible links 101 are mounted. Because the fuse box 105 has the partition walls 107, a pitch P2 in the arranging direction of the fusible links 101 is equal to a sum of the width H1 of the fuse housing and a thickness H2 of the partition wall 107.

In the above described structure, by employing the arrangement as shown in FIGS. 11A and 11B, it is advantageously possible to achieve reduction of the size in the arranging direction of the fusible links 101. Moreover, the reduction in size leads to such advantage that the fuse box can be made compact.

PRIOR ART REFERENCE

Patent Reference

[Patent Reference 1] Japanese Patent Publication No. JP-A-2010-33800

In the above described prior art, such a structure that reduction of the size can be achieved by omitting the three partition walls 107 each having the thickness H2 is realized. In order to achieve further reduction in size, the inventors of this application are paying attention to the following matters. Specifically, the inventors are paying attention to a fact that in case where the four fusible links 101 having the monopole structure are arranged in parallel, two walls of the fuse housings are opposed to each other in a region where the two fusible links 101 are juxtaposed. The inventors of this application consider that the further reduction of the size can be achieved, by reducing the walls from two to one in the region where the two fusible links 101 are juxtaposed. The inventors of this application consider, as a specific measure, to form a four-series fusible link (herein, the number of the series is simply selected in conformity with FIGS. 11A, 11B, 12A and 12B, but a three-series fusible link and so on may be also selected).

However, the inventors of this application have such an anxiety that in case where the four-series fusible link, for example, is formed, the cavity is limited to an exclusive use for the four-series fusible link only, and the fusible link 101 having the monopole structure cannot be mounted in the same cavity.

SUMMARY

The invention has been made in view of the above described circumstances, and an object of the invention is to provide a fusible link mounting structure capable of enhancing versatility, while achieving reduction in size, and an electrical junction box employing the structure.

According to one aspect of the present invention, there is provided a fusible link mounting structure, including:

an n-series fusible link (n is an integer of three or more) which is formed by providing n-pieces of fuse elements in series within a single common housing;

a monopole fusible link which is formed by providing a piece of fuse element in a single monopole housing;

a cavity having a mounting space to have the common housing or the monopole housing mounted therein, which is formed according to a size of the common housing; and a plurality of terminals which are projected from a bottom of the cavity into the mounting space, or projected by passing through a bottom of the cavity into the mounting space, the terminals and the fuse elements of the n-series fusible link being electrically connected when the common housing is mounted in the cavity, and one of the terminals and the fuse element of the monopole fusible link being electrically connected when the monopole housing is mounted in the cavity; wherein a total length of the mounting space is set to be shorter than a sum of lengths of n-pieces of the monopole housings, and a plurality of the terminals are arranged corresponding to positions of a plurality of fuse terminals which are provided in the n-series fusible link, and also arranged at such positions that a plurality of the terminals do not interfere with the monopole housing, when the monopole fusible link is mounted in the cavity.

The fusible link mounting structure may be configured such that a plurality of the terminals are arranged in such an arrangement that a non-mounted space is created at one side or at both sides of the monopole housing, when the monopole fusible link is mounted in the cavity.

The fusible link mounting structure may be configured such that the cavity is provided with a plurality of guides extending in a mounting direction of the fusible link.

The fusible link mounting structure may be configured such that the cavity is provided with at least a pair of cutouts which are formed by concaving an open edge of the cavity.

According to another aspect of the present invention, there is provided an electrical junction box characterized by employing at least one of the above described fusible link mounting structures.

DETAILED DESCRIPTION OF EMBODIMENTS

The invention relates to a structure using an n-series fusible link, and also relates to a structure where a plurality of terminals protruded from a bottom of a cavity or a plurality of terminals provided at a backward position than the bottom of the cavity are arranged in the following manner. Specifically, according to the structure, a plurality of the terminals are arranged according to positions of a plurality of fuse terminals which are provided on the n-series fusible link, and a plurality of the terminals are arranged so as not to interfere with a monopole housing, on occasion of mounting a monopole fusible link.

Figure 1:
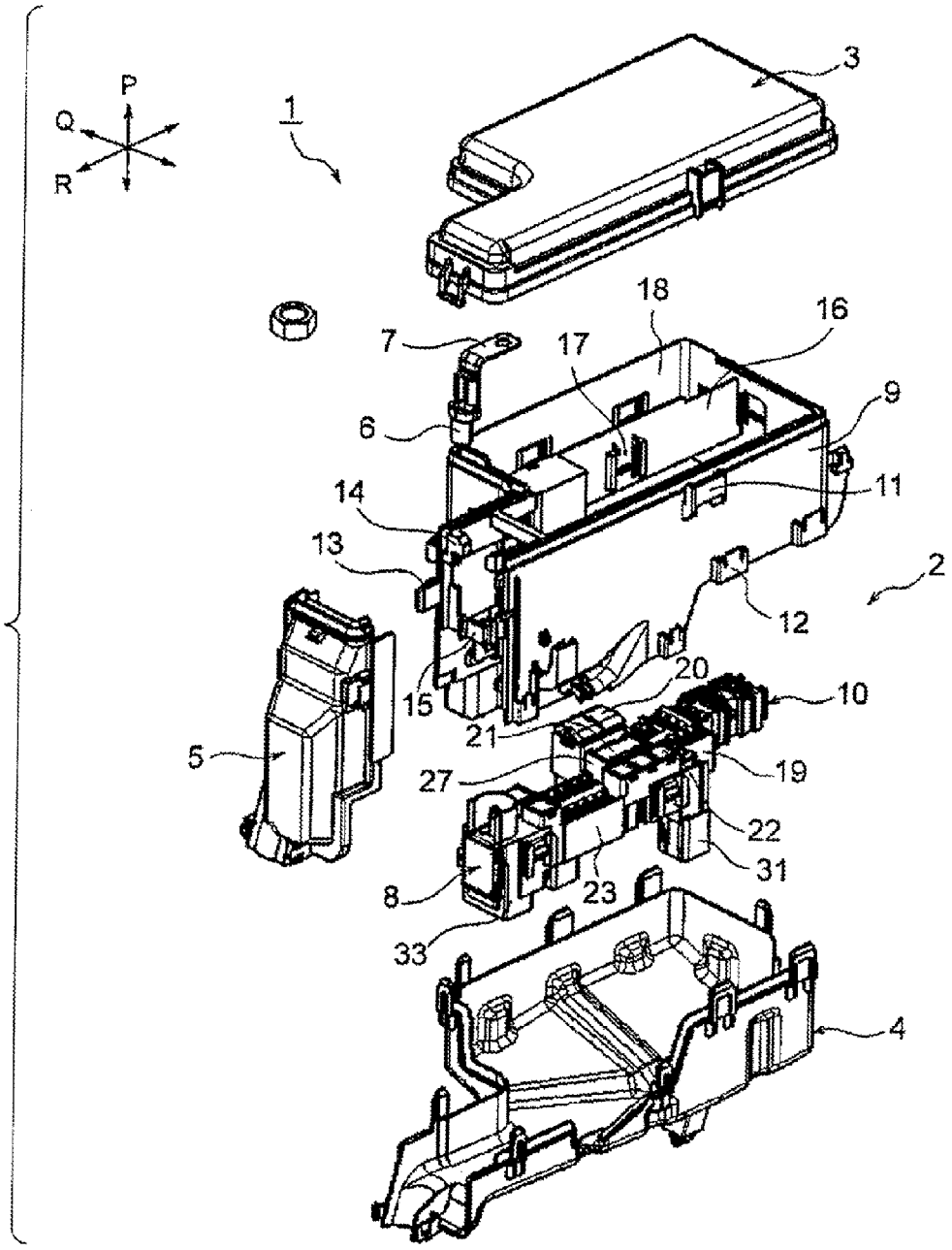
FIG. 1 is an exploded perspective view showing an electrical junction box according to an embodiment of the present invention.
Figure 2:
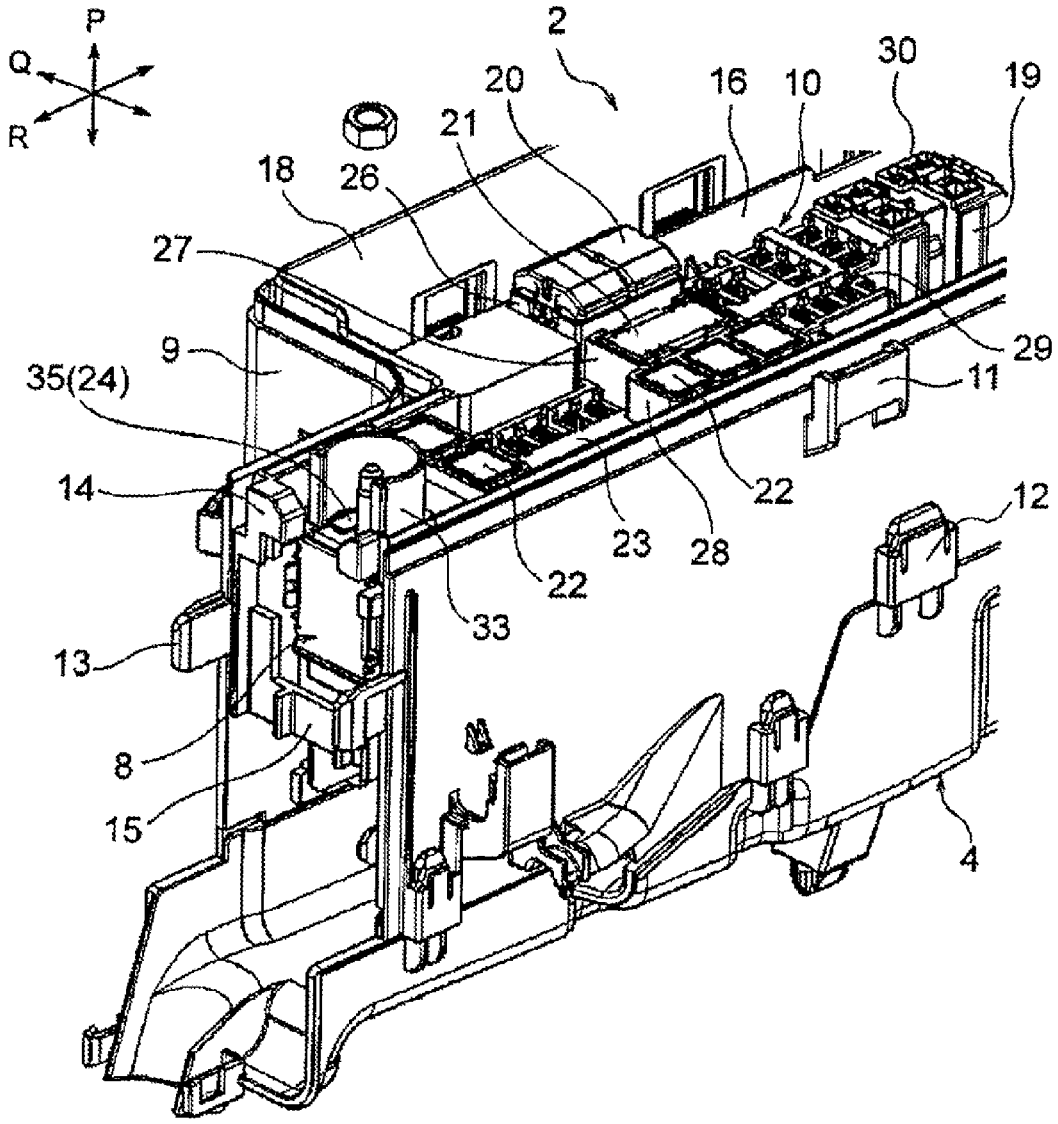
FIG. 2 is an enlarged perspective view of a main body of the electrical junction box.
Figure 3:
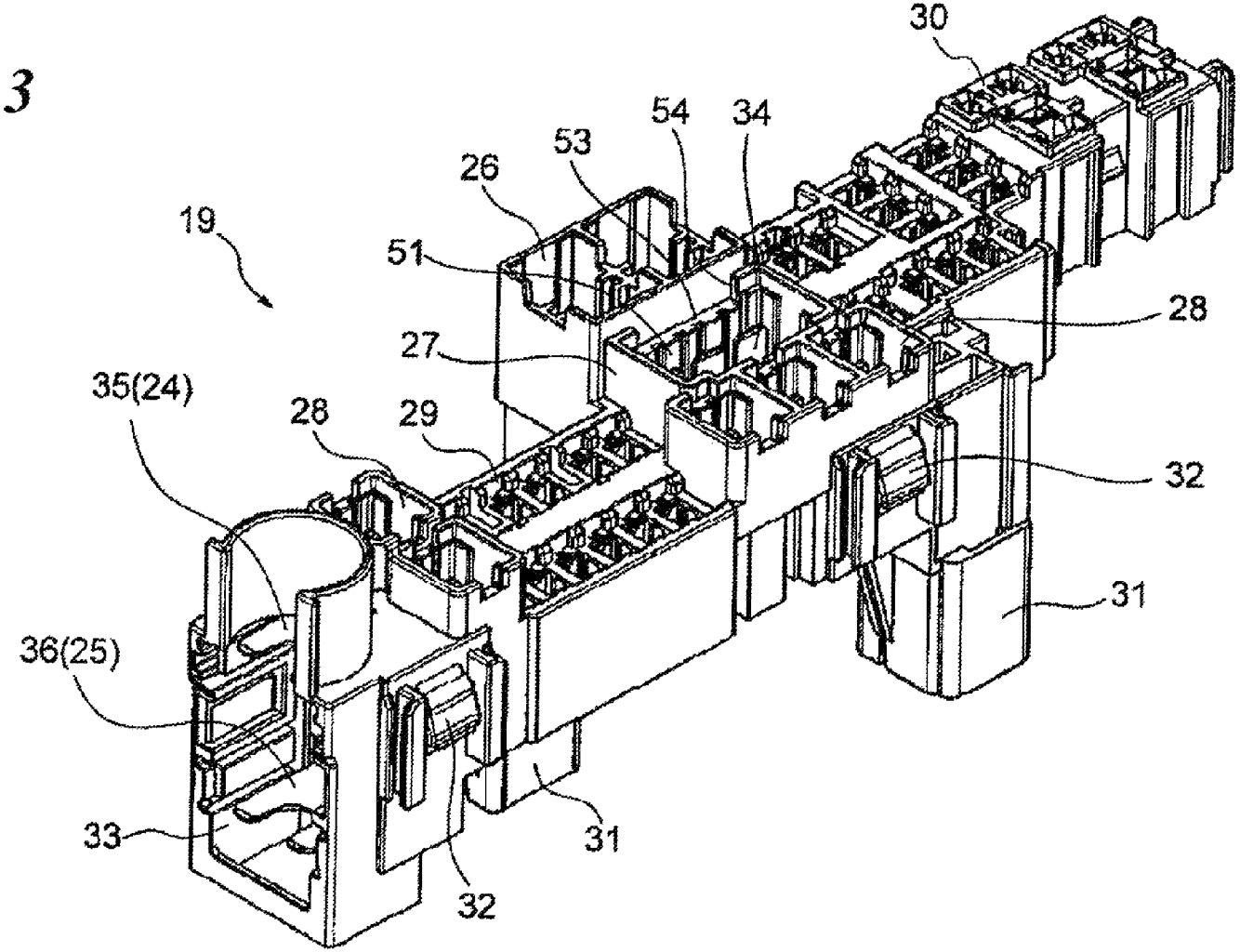
FIG. 3 is a perspective view of a cassette block.
Figure 4A:
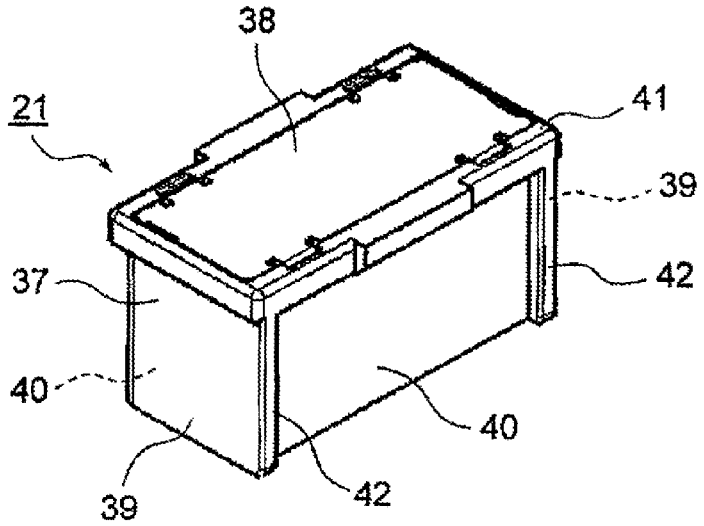
FIG. 4A is a perspective view of a three-series fusible link.
Figure 4B:
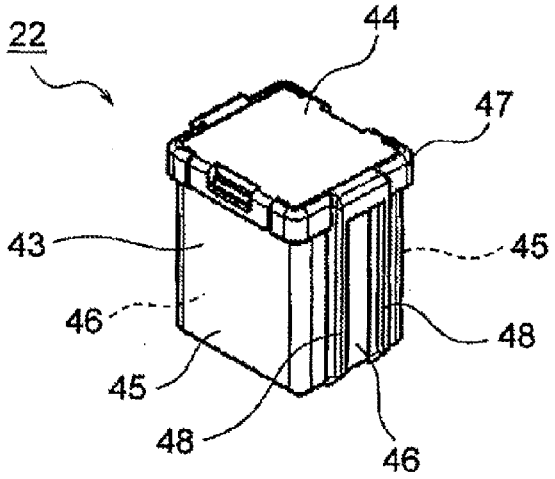
FIG. 4B is a perspective view of a monopole fusible link.
Figure 4C:
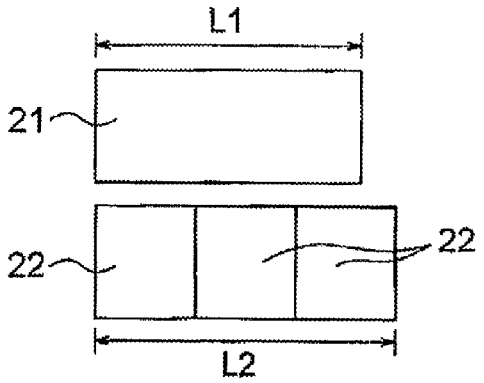
FIG. 4C is a schematic view showing a difference in total length between the three-series fusible link and the monopole fusible link.
Figure 5A:
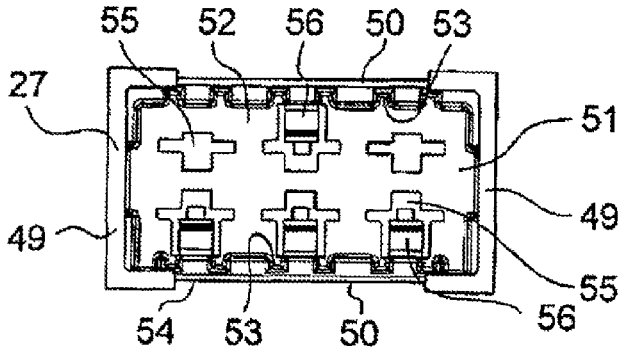
FIG. 5A is a plan view of a cavity.
Figure 5B:
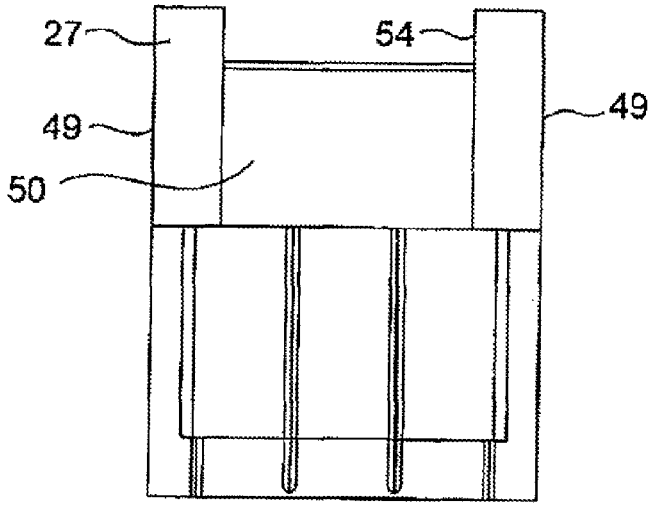
FIG. 5B is a side view of the cavity.
Figure 5C:
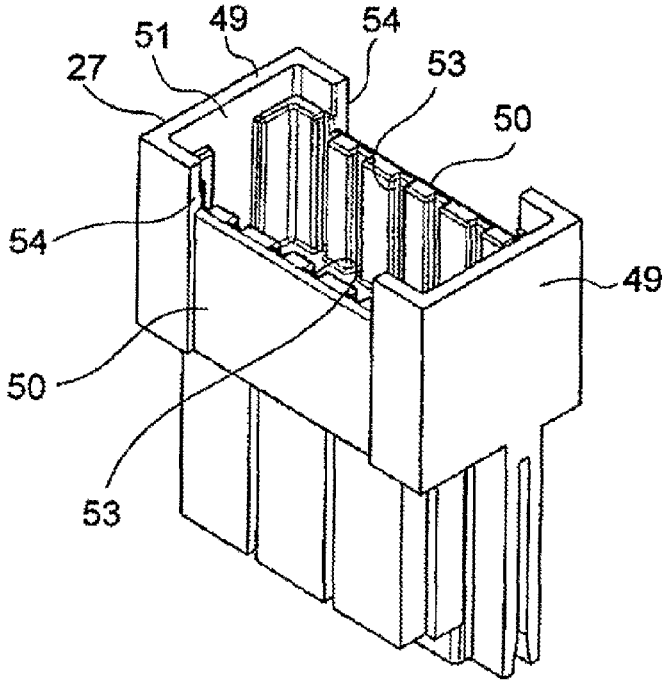
FIG. 5C is a perspective view of the cavity.
Figure 6A:
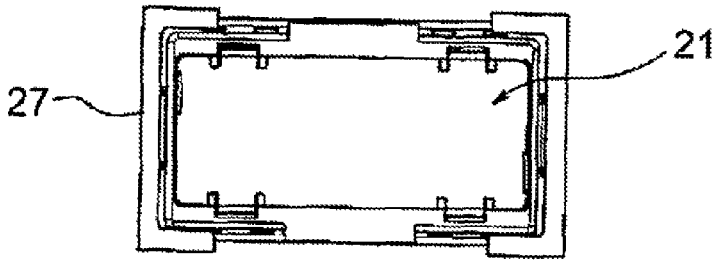
FIG. 6A is a plan view of the cavity when the three-series fusible link is mounted.
Figure 6B:
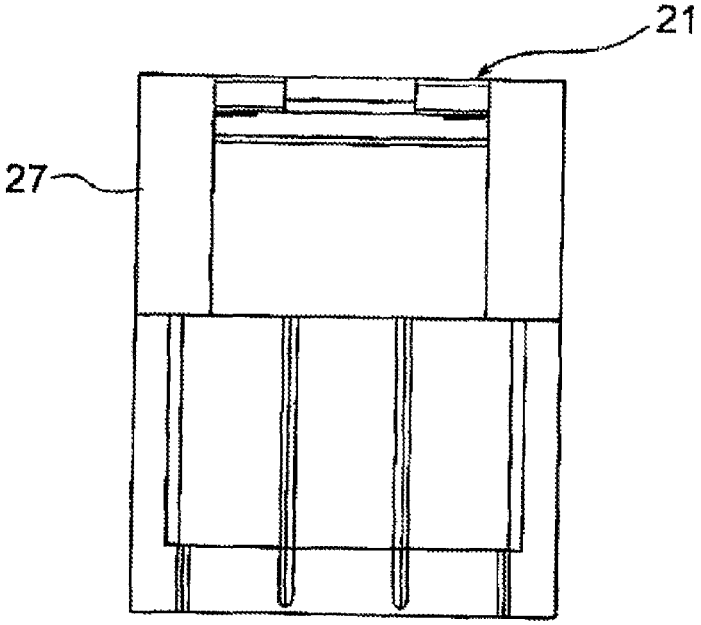
FIG. 6B is a side view of the cavity when the three-series fusible link is mounted.
Figure 6C:
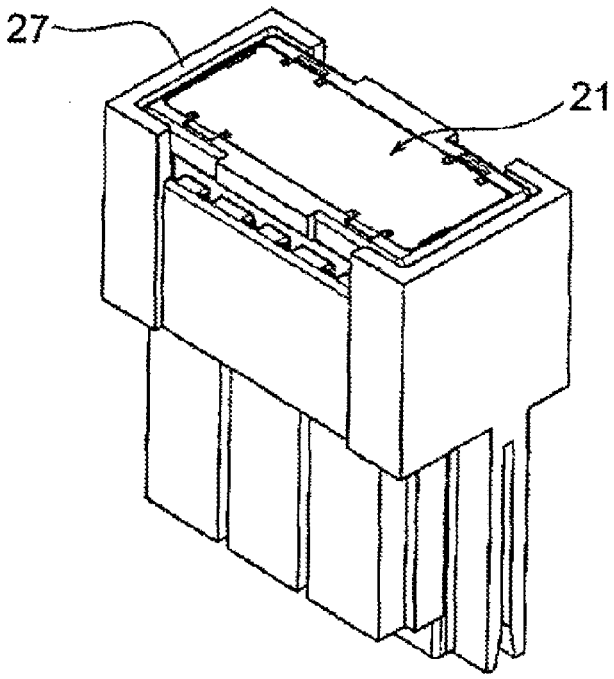
FIG. 6C is a perspective view of the cavity when the three-series fusible link is mounted.
Figure 7A:
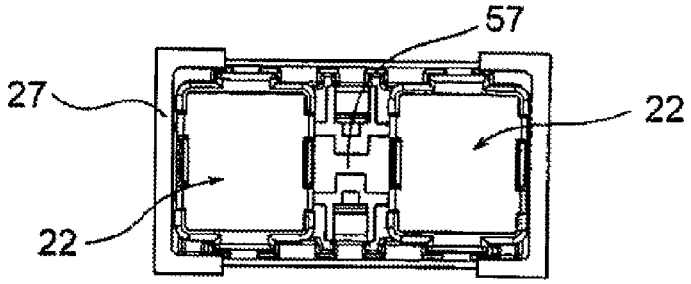
FIG. 7A is a plan view of the cavity when two pieces of the monopole fusible links are mounted.
Figure 7B:
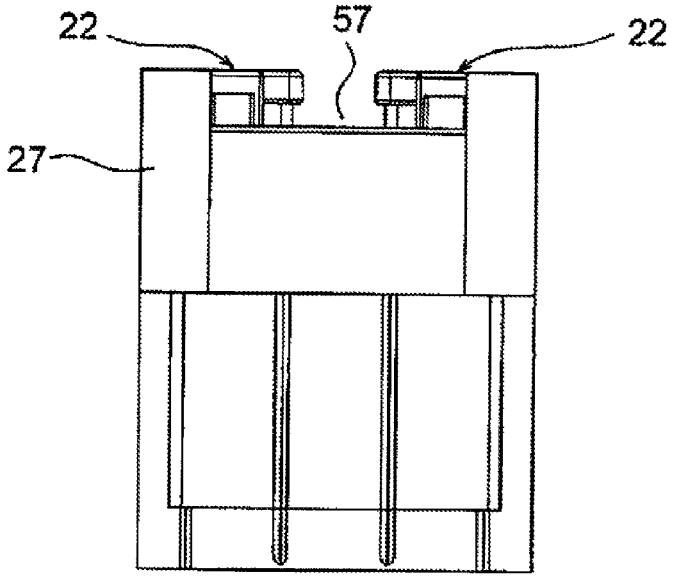
FIG. 7B is a side view of the cavity when the two monopole fusible links are mounted.
Figure 7C:
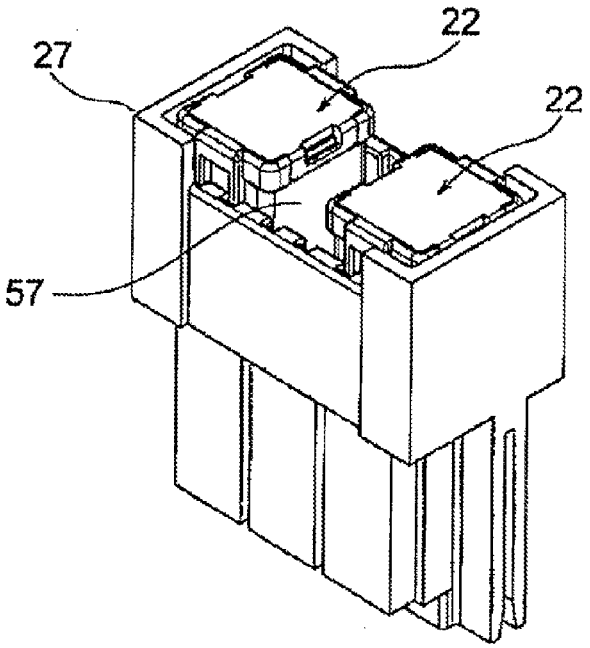
FIG. 7C is a perspective view of the cavity when the two monopole fusible links are mounted.
Figure 8A:
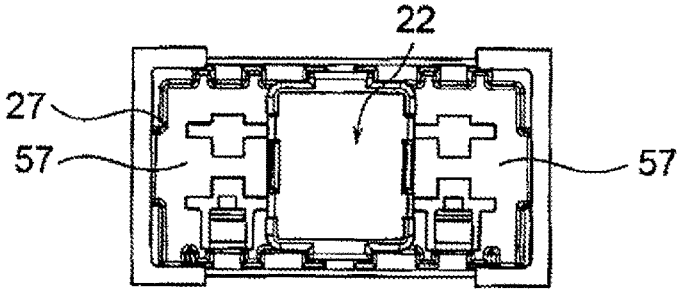
FIG. 8A is a plan view of the cavity when a piece of the monopole fusible link is mounted.
Figure 8B:
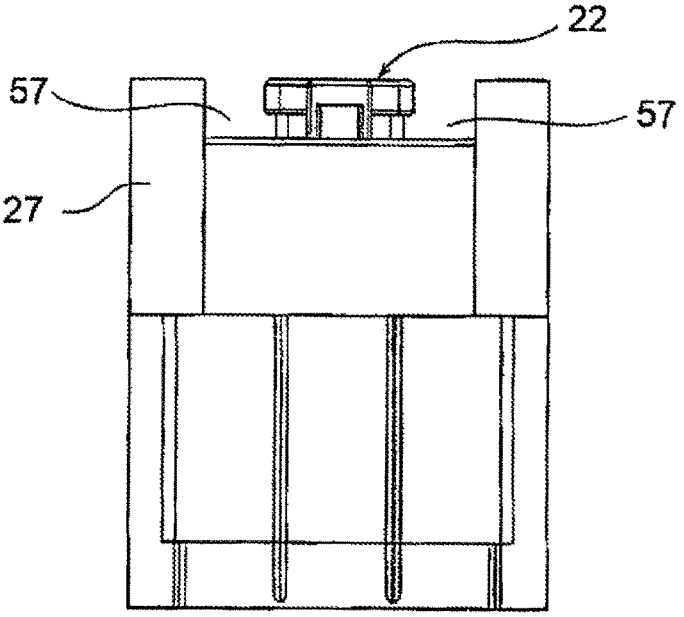
FIG. 8B is a side view of the cavity when the monopole fusible link is mounted.
Figure 8C:
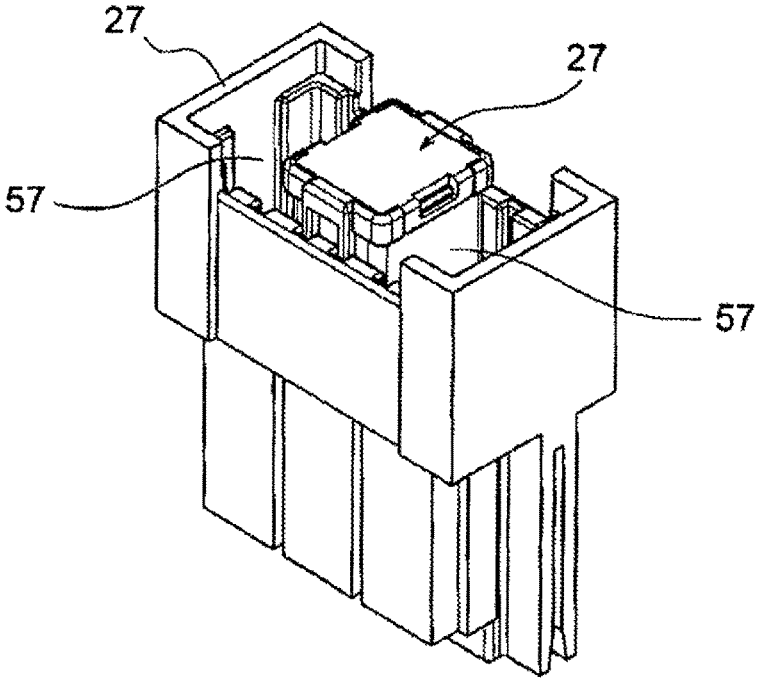
FIG. 8C is a perspective view of the cavity when the monopole fusible link is mounted.

An embodiment will be described hereunder, referring to the drawings. FIG. 1 is an exploded perspective view showing an electrical junction box according to an embodiment of the present invention. Moreover, FIG. 2 is an enlarged perspective view of a main body of the electrical junction box, FIG. 3 is a perspective view of a cassette block, FIGS. 4A to 4C are views showing fusible links, FIGS. 5A to 5C are views showing a cavity, FIGS. 6A to 6C are views showing the cavity, when a three-series fusible link is mounted, FIGS. 7A to 7C are views showing the cavity, when two pieces of the monopole fusible links are mounted, and FIGS. 8A to 8C are views showing the cavity, when a piece of the monopole fusible link is mounted. FIGS. 9A, 9B, 10A and 10B are perspective views of the cavity.

In the following description, specific shapes, materials, numerical values, directions, etc. are only examples for enabling the invention to be easily understood, and it is to be noted that they can be appropriately modified according to use, object, specification, etc. of the invention.

In FIGS. 1 and 2, an arrow mark P represents a vertical direction, an arrow mark Q represents a lateral direction, and an arrow mark R represents a longitudinal direction.

In FIGS. 1 and 2, an electrical junction box 1 as an electrical appliance to be mounted on a vehicle (not shown) such as an automobile includes a main body 2 of the electrical junction box, an upper cover 3, a lower cover 4, and a side cover 5. A terminal metal fitting 7 provided on a terminal end of an electric wire 6, a wire harness which is not shown, and so on are connected to the electrical junction box 1 having such a structure as described above.

The electric wire 6 is connected to an alternator which is not shown. The terminal metal fitting 7 is connected to a terminal fitting part (described below) of the main body 2 of the electrical junction box. The terminal fitting part is covered with the side cover 5 so that a connection part and so on can be protected. The terminal fitting part is disposed at such a position that it can be easily exposed, when the side cover 5 is removed.

As the terminal fitting part, a detachable FL bolt block 8 is used. This FL bolt block 8 has a function of a fusible link to be a main fusible link. The FL bolt block 8 is disposed at the position covered with the side cover 5, as described above. This results in the fact that the FL bolt block 8 is disposed at such a position that its maintenance can be easily conducted.

One end of the wire harness, which is not shown, is connected to a lower part of the main body 2 of the electrical junction box by means of a connector or the like. When the one end is withdrawn from the lower cover 4, the one end is arranged along a predetermined path. The other end of the wire harness, which is not shown, is connected, for example, to a junction block or the like.

The electrical junction box 1 is fixed at a predetermined position of the vehicle. In this embodiment, the electrical junction box 1 is fixed at a predetermined position in an engine room by appropriate means.

The main body 2 of the electrical junction box includes a housing 9 which is formed of synthetic resin having insulating property, and a cassette block assembly 10 which is engaged with an inside of this housing 9. A functional part of the electrical junction box 1 is concentrated in the cassette block assembly 10.

The housing 9 is a resin molded article, and an open part at its upper end is formed as an engaging part to be engaged with the upper cover 3. A plurality of lock portions 11 are formed in this engaging part at the upper end. An open part at a lower end of the housing 9 is formed as an engaging part to be engaged with the lower cover 4. A plurality of lock portions 12 are formed in this engaging part at the lower end. Further, an open part at one side of the housing 9 is formed as an engaging part to be engaged with the side cover 5. A plurality of lock portions 13 are formed in this engaging part at the one side.

The open part at the one side is formed in such a shape that the open part can be opposed to the FL bolt block 8 of the cassette block assembly 10, and the FL bolt block 8 can be detachably mounted.

In the open part at the one side, reference numeral 14 represents a terminal guiding part, while reference numeral 15 represents a bridge part.

The terminal guiding part 14 is formed in such a shape that the terminal metal fitting 7 can be guided when it is connected to the FL bolt block 8, and arrangement of this terminal metal fitting 7 can be regulated. The bridge part 15 is so formed as to transverse the open part.

An engaging part 16 to be engaged with the cassette block assembly 10 is formed inside the housing 9. This engaging part 16 is formed in such a manner that the cassette block assembly 10 can be inserted from the open part at the lower end of the housing 9 toward the engaging part at the upper end, and the cassette block assembly 10 can be engaged with the inside of the housing 9. The engaging part 16 is so formed that a space can be formed according to a size of the cassette block assembly 10. A plurality of lock portions 17 are formed in the engaging part 16.

Reference numeral 18 represents an engaging part to be engaged with another cassette block assembly which is not shown.

The cassette block assembly 10 includes a cassette block 19, a fusible link 20, a three-series fusible link 21, and a monopole fusible link 22 which are mounted at predetermined positions of the cassette block 19, a fuse (not shown) and a relay (not shown) which are mounted at predetermined positions of the cassette block 19, and the above described FL bolt block 8. The FL bolt block 8 has a function of the main fusible link, as described above.

In FIGS. 2 and 3, the cassette block 19 includes a block housing 23 having insulating property, and electrically conductive bus bars 24, 25 which are assembled to this block housing 23.

The block housing 23 is a resin molded article, and formed in a shape elongated in a direction of the arrow mark R, in this embodiment (This shape is merely an example). A number of cavities are formed in the block housing 23. Reference numerals 26, 27 and 28 respectively represent the cavities for the fusible link 20, the three-series fusible link 21, and the monopole fusible link 22. Moreover, reference numerals 29 and 30 represent the cavities for the fuse and relay which are not shown.

The cavity 26 is formed in a shape according to a size of the fusible link 20. The cavity 27 is formed in a shape according to sizes of the three-series fusible link 21 and the monopole fusible link 22. Moreover, the cavity 28 is formed in a shape according to a size of the monopole fusible link 22. The cavities 29 and 30 are respectively formed in shapes according to specifications of the fuse and relay which are not shown.

The block housing 23 has, at its lower side, a plurality of connector housings 31, as connecting parts to be connected to the wire harness which is not shown. Moreover, a plurality of lock portions 32 are formed in side parts of the block housing 23. The lock portions 32 are formed as the portions to be engaged with the lock portions 17 of the engaging part 16 (See FIG. 1) which is formed inside the housing 9.

The block housing 23 is provided with a mounting part 33 for the FL bolt block at its one end in the direction of the arrow mark R. In other words, the mounting part 33 for the FL bolt block is formed in the block housing 23 so as to be opposed to the open part at the one side of the housing 9 (the side part of the main body 2 of the electrical junction box). This mounting part 33 for the FL bolt block is formed as the part for enabling the FL bolt block 8 to be mounted or detached along the direction of the arrow mark R, and further, as the part corresponding to a connecting position of the terminal metal fitting 7 at the terminal end of the electric wire 6.

The bus bars 24, 25 are formed by stamping metallic plates having electrical conductivity. The bus bars 24, 25 are circuit components, and are so formed as to have respective desired paths. The bas bars 24, 25 are used as the bus bar for the alternator, and as the bus bar for the battery.

A number of tabs 34 are formed between the bus bar 24 and the bus bar 25, as electrical connecting parts. The tabs 34 are arranged and formed corresponding to positions of the aforesaid cavities 26 to 30 such that the tabs 34 are projected from respective bottoms of the cavities 26 to 30. Specifically, the tabs 34 corresponding to the cavity 27 are projected from the bottom of the cavity 27 into the mounting space 51. The bus bars 24, 25 are extended in the direction of the arrow mark R, and a number of the tabs 34 are projected therefrom on the way.

The tabs 34 corresponding to the cavity 27 correspond to "the terminals" which is described in the claims.

The bus bar 24 has a first connecting mate 35 which is a connecting mate of the FL bolt block 8 (See FIGS. 1 and 2). Moreover, the bus bar 25 also has a second connecting mate 36 which is a connecting mate of the FL bolt block 8. The first connecting mate 35 and the second connecting mate 36 are so formed as to be positioned at the one end in the direction of the arrow mark R. Moreover, the first connecting mate 35 and the second connecting mate 36 are so formed as to protrude into an internal space of the mounting part 33 for the FL bolt block. The first connecting mate 35 and the second connecting mate 36 are adapted to be connected to the main fusible link, which is not shown, for constituting the FL bolt block 8.

Then, the three-series fusible link 21, the monopole fusible link 22, the cavity 27, and the tab 34 according to one embodiment of the present invention will be described below.

In FIG. 4A, the three-series fusible link 21 includes three fuse elements (not shown), a single common housing 37, and a single fusible body cover 38. The three fuse elements are known fuse elements which are arranged in series at a predetermined interval. Each of the fuse elements has a fusible body and fuse terminals which are continued from both ends of the fusible body. Because the three fuse elements are arranged in series, this fusible link 21 is called as a "three-series" fusible link (Although the three-series fusible link is described in this embodiment, the fuse elements may be arranged in four series, in five series, or in six series, which may be called as an n-series fusible link (n is an integer of three or more)).

The common housing 37 is a resin molded article having insulating property, and formed in a box-like shape (in a shape of a box having a substantially rectangular shape in a plan view), as shown in the drawings, including a pair of side walls 39 which are opposed to each other, and a pair of side walls 40 which are similarly opposed to each other, an upper frame 41, and a lower end opening, which is not shown. The common housing 37 is formed in such a manner that the three fuse elements, which are not shown, can be contained and held therein. The common housing 37 is called herein as "common", because it is commonly used for the three fuse elements. A structure for containing and holding the fuse elements is substantially same as the conventional structure.

The fuse terminals of the fuse elements are arranged at such positions as can be accessed from the lower end opening of the common housing 37. Moreover, the fusible bodies of the fuse elements are arranged at such positions as can be accessed from the upper frame 41. The fusible bodies are covered with a fusible body cover 38 which is engaged with the upper frame 41 to be protected. The fusible body cover 38 is molded of transparent resin material for enabling conditions of the fusible bodies to be visually observed. The fusible body cover 38 is molded into a predetermined shape. The fusible body cover 38 as described above is provided with a plurality of lock portions (reference numeral thereof is omitted). The lock portions are formed as the engaging portions to be engaged with the upper frame 41.

A pair of the side walls 39 and a pair of the side walls 40 respectively have flat surfaces. Each of a pair of the side walls 40 which is the latter out of a pair of the side walls 39 and a pair of the side walls 40 is provided with two guides 42. The guides 42 are in a shape of a convex rib, and are specifically, so formed as to straightly extend from a lower end position of the common housing 37 to the upper frame 41. The guides 42 are so formed as to straightly extend in a mounting direction of the three-series fusible link 21. In this embodiment, the guides 42 as described above are arranged in connection parts with respect to the side walls 39.

The upper frame 41 is formed in a shape of a rectangular frame, as seen from the above. Moreover, the upper frame 41 is so formed as to slightly project outward from a pair of the side walls 39 and a pair of the side walls 40. The projected portions are used as pullers or hooks for a tool, which is not shown, when the three-series fusible link 21 is removed.

In FIG. 4B, the monopole fusible link 22 includes a single fuse element (not shown), a single monopole housing 43, and a single fusible body cover 44. The monopole fusible link 22 is provided with one of the known fuse elements which are provided in the three-series fusible link 21, and considered to be the same as a generally-called "fusible link". Because the monopole fusible link 22 has the single fuse element, it is called as the "monopole" fusible link for distinguishing it from the "three-series" of the above described "three-series" fusible link 21.

The monopole housing 43 is a resin molded article having insulating property, and formed in a box-like shape (in a shape of a box having a substantially square shape in a plan view), including a pair of side walls 45 which are opposed to each other, and a pair of side walls 46 which are similarly opposed to each other, an upper frame 47, and a lower end opening, which is not shown. The monopole housing 43 is formed in such a manner that the single fuse element, which is not shown, can be contained and held therein. A structure for containing and holding the fuse element is substantially same as the conventional structure.

A pair of the side walls 45 and a pair of the side walls 46 respectively have flat surfaces. Each of a pair of the side walls 46 which are the latter out of a pair of the side walls 45 and a pair of the side walls 46 is provided with two guides 48. The guides 48 are in a shape of a convex rib, and are specifically so formed as to straightly extend from a lower end position of the monopole housing 43 to the upper frame 47. The guides 48 are so formed as to straightly extend in a mounting direction of the monopole fusible link 22. In this embodiment, the guides 48 as described above are arranged at positions where the side walls 46 are divided in three.

The upper frame 47 is formed in a shape of a substantially square frame, as seen from the above. Moreover, the upper frame 47 is so formed as to slightly project outward from a pair of the side walls 45 and a pair of the side walls 46. The projected portions are used as pullers or hooks for the tool, which is not shown, in the same manner as in the three-series fusible link 21.

In FIG. 4C, a rectangular shape in the drawing schematically shows the three-series fusible link 21. This three-series fusible link 21 has a total length L1, which is a length in the longitudinal direction. On the other hand, three square shapes which are arranged in series schematically show the three monopole fusible links 22. A total length of the three square shapes is L2.

As understood from FIG. 4C, the total length L1 of the three-series fusible link 21 is shorter than the total length L2 of the three monopole fusible links 22 (L1<L2). This is because the two side walls 45 in FIG. 4B are provided between the monopole fusible links 22, for the purpose of separating the fuse elements, which are not shown, resulting in separation more than required. In the three-series fusible link 21, the only one side wall 45 is sufficient, and this is a difference to be influenced on the total length.

Comparing the three-series fusible link 21 with the monopole fusible links 22 which are arranged in three series, it is found that the three-series fusible link 21 has a reduced size.

Figure 11B:
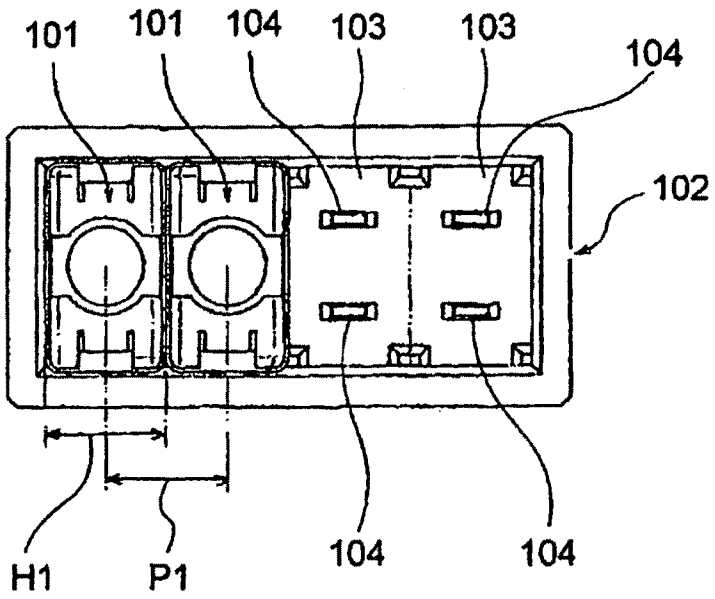
FIG. 11B (Prior Art)
FIG. 11B is a plan view of the fusible links and the fuse box in the conventional case.
Figure 11A:
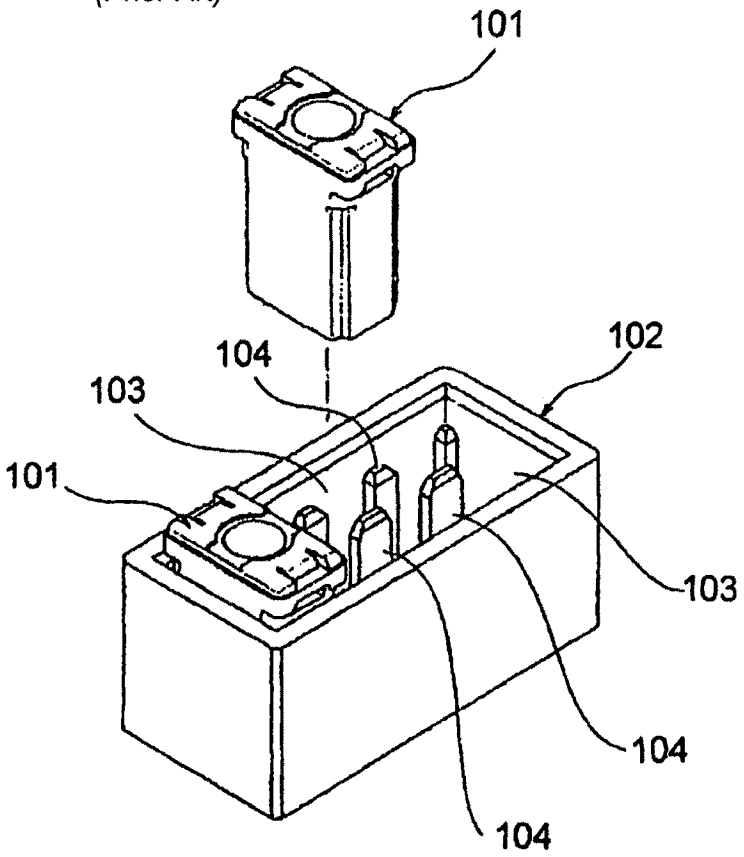
FIG. 11A (Prior Art)
FIG. 11A is a perspective view of fusible links and a fuse box (a partition wall is not provided) in a conventional case.
Figure 12B:
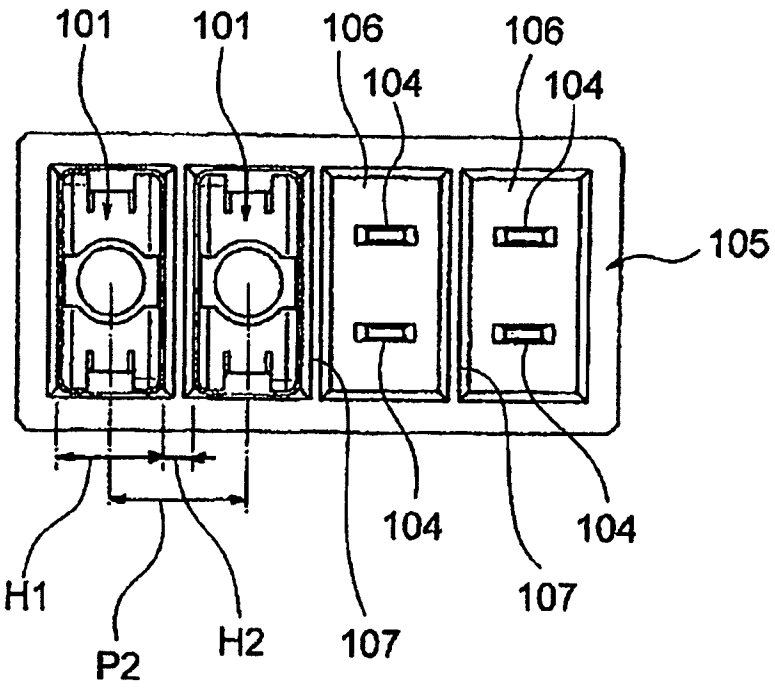
FIG. 12B (Prior Art)
FIG. 12B is a plan view of the fusible links and the fuse box in the conventional case.
Figure 12A:
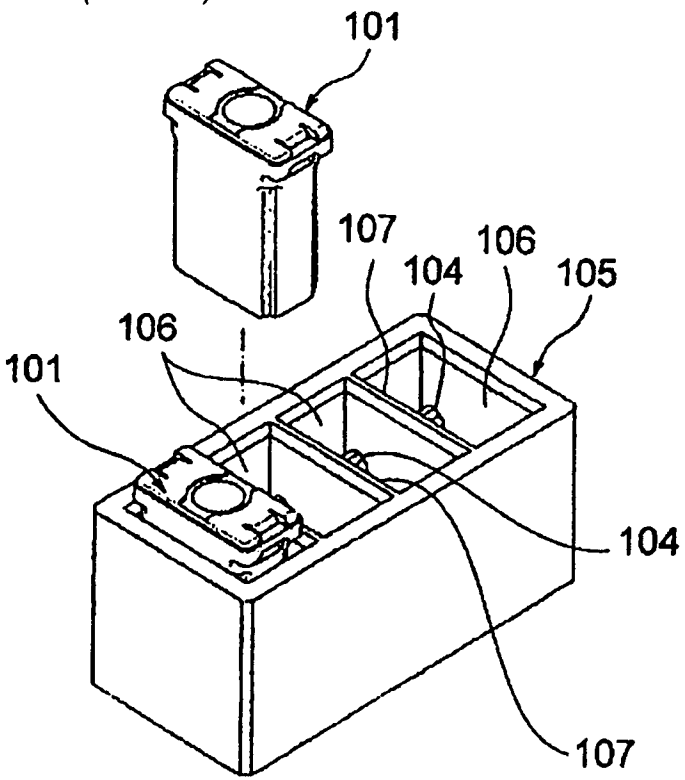
FIG. 12A (Prior Art)
FIG. 12A is a perspective view of the fusible links and a fuse box (partition walls are provided) in another conventional case.

It is found that in view of reduction of the size, the monopole fusible links 22 which are arranged in three series correspond to the structure in the prior art as shown in FIGS. 11A and 11B. In other words, it is found that the three-series fusible link 21 has the reduced size as compared with the prior art.

In FIGS. 5A, 5B and 5C, the cavity 27 which is shown in the drawing is extracted from the cassette block 19 (See FIG. 3), for convenience of explanation. The cavity 27 is formed as a resin molded part for mounting the fusible link. The cavity 27 is formed in such a shape as shown in the drawing, including a pair of side walls 49 which are opposed to each other, a pair of side walls 50 which are similarly opposed to each other, a mounting space 51, and a bottom wall 52. The cavity 27 is formed in such a manner that the mounting space 51 is surrounded with a pair of the side walls 49 and a pair of the side walls 50, and an opening is formed at an upper end of the cavity so as to be continued to the mounting space 51.

A pair of the side walls 49 and a pair of the side walls 50 opposed to each other are so formed as to correspond to a pair of the side walls 39 and a pair of the side walls 40 of the three-series fusible link 21 (See FIG. 4A).

A pair of the side walls 49 and a pair of the side walls 50 opposed to each other are so formed as to correspond also to a pair of the side walls 45 and a pair of the side walls 46 of the monopole fusible link 22 (See FIG. 4B), for enabling not only the three-series fusible link 21 but also the monopole fusible link 22 to be mounted.

A plurality of guides 53 are formed on inner faces of a pair of the side walls 50. The guides 53 are formed in a concave shape (in a shape of a groove) so that they can guide the guides 42 of the three-series fusible link 21 (See FIG. 4A) and the guides 48 of the monopole fusible link 22 (See FIG. 4B). Moreover, the guides 53 are so formed as to straightly extend in the mounting direction of the three-series fusible link 21 and the monopole fusible link 22.

A pair of the side walls 50 are respectively provided with cutouts 54 in a shape concaved from open edges at their upper ends. Each of the cutouts 54 is formed as an escape for the aforesaid tool, which is not shown, and has such a shape and width that the three-series fusible link 21 and the monopole fusible link 22 (See FIGS. 4A and 4B) can be caught by the tool to be removed. In this embodiment, the guides 53 are formed so as to be continued to edges of the cutouts 54.

The mounting space 51 is a space surrounded with a pair of the side walls 49 and a pair of the side walls 50, as described above, and its total length is set to be substantially equal to the total length L1 (See FIG. 4C) of the three-series fusible link 21.

The cavity 27 is made compact as compared with the prior art, because the total length of the mounting space 51 is substantially equal to L1.

A plurality of tab inserting holes 55 are formed so as to pass through the bottom wall 52 which is a bottom of the cavity 27. The tab inserting holes 55 are formed as the parts through which the tabs 34 project. It is to be noted that the tabs 34 in this embodiment have a known shape (See FIG. 9A).

The tab inserting holes 55 are arranged and formed corresponding to positions of a plurality of the fuse terminals, which is not shown, of the three-series fusible link 21 (See FIG. 4A). Moreover, the tab inserting holes 55 are formed not only at such positions, but also at the following positions. Specifically, because the monopole fusible link 22 (See FIG. 4B) can also be mounted in the cavity 27, the tab inserting holes 55 are arranged and formed at such positions that they do not interfere with the monopole housing 43 (See FIG. 4B), when the monopole fusible link 22 is mounted.

Reference numerals 56 near the tab inserting holes 55 represent lock parts for the bus bars. In case where the three-series fusible link 21 (See FIG. 4A) is mounted in the cavity 27, the lock parts 56 are used as the parts for locking the bus bars 24, 25 (See FIG. 3). On the other hand, in case where the monopole fusible link 22 (See FIG. 4B) is mounted in the cavity 27, the lock parts 56 are used as the parts for locking the bus bar 24 and other bus bars, or as the parts for locking the terminals or the like.

Figure 9A:
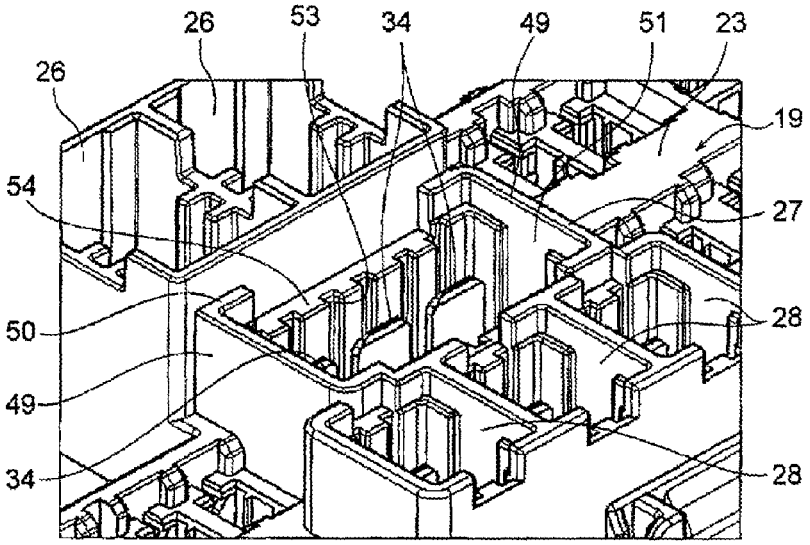
FIG. 9A is a perspective view of the cavity.
Figure 9B:
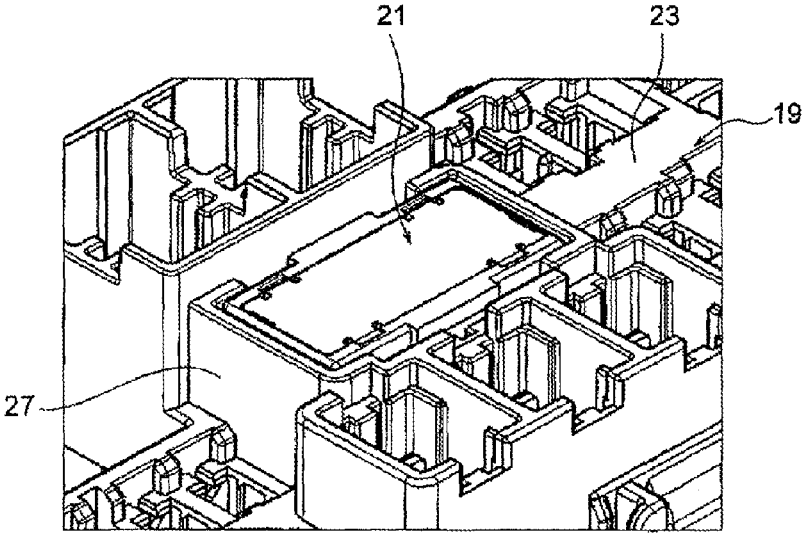
FIG. 9B is a perspective view of the cavity when the three-series fusible link is mounted.
Figure 10A:
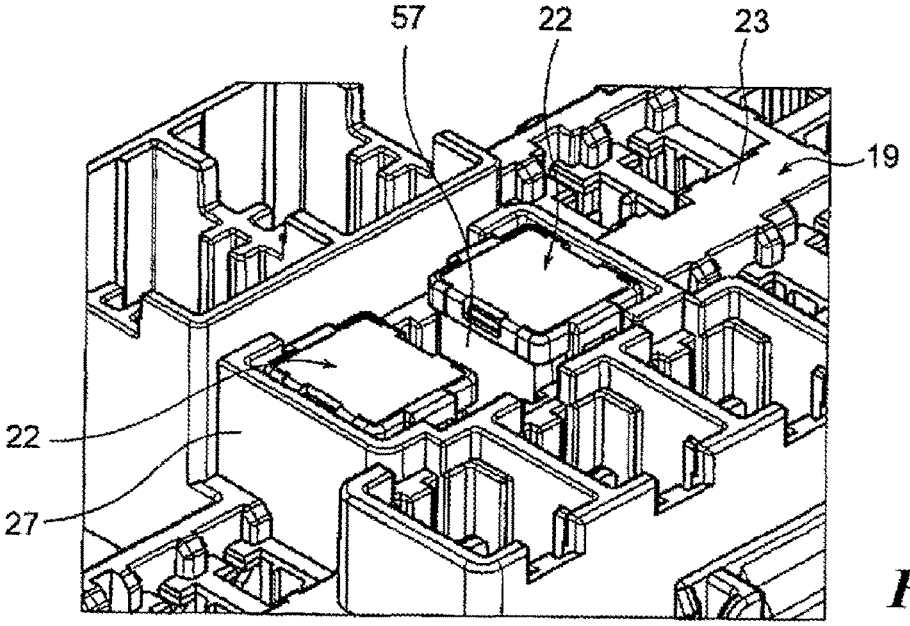
FIG. 10A is a perspective view of the cavity when two pieces of the monopole fusible links are mounted.
Figure 10B:
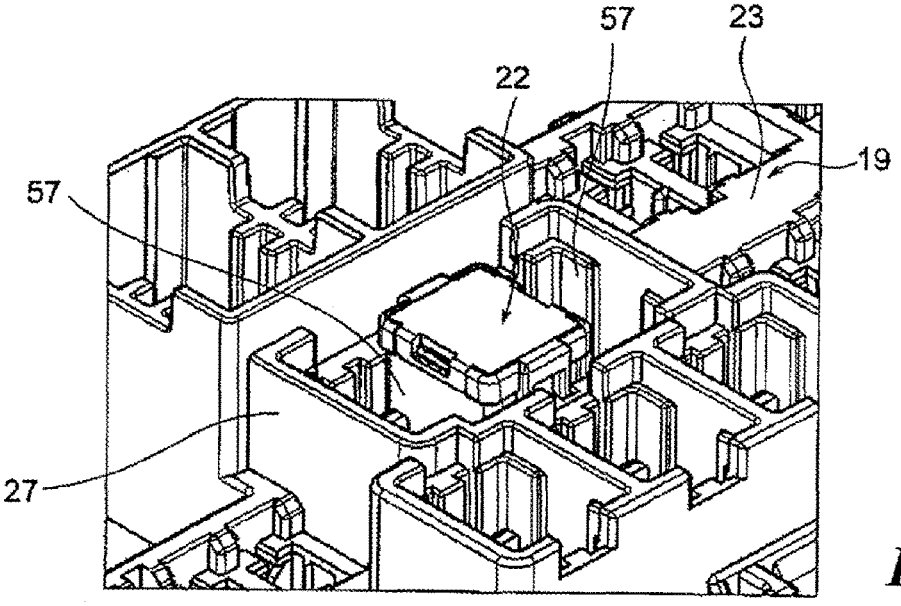
FIG. 10B is a perspective view of the cavity when a piece of the monopole fusible link is mounted.

When the three-series fusible link 21 is mounted in the cavity 27 in the above described structure, the three-series fusible link 21 is mounted in a state as shown in FIGS. 6 and 9B.

As understood from FIG. 9B, the three-series fusible link 21 is said to be the fusible link having a reduced size. This is because in FIG. 9B, the cavities 28 for the monopole fusible links 22 are provided in three series, at a front side of the cavity 27 in the drawing, and it is found that the size of the three-series fusible link 21 is apparently reduced in size, as compared with the three cavities 28.

In case where the size reduction is intended at the position of the cavity 27, it would be advantageous to use the cavity 27 and the three-series fusible link 21, without using the three cavities 28 and the three monopole fusible links 22.

As described above, the cavity 27 is not an exclusive cavity for the three-series fusible link 21, but can be used also as the cavity for the monopole fusible link 22.

Moreover, it is understood that up to only two pieces of the monopole fusible links 22 are enough to be mounted. This is because in case where three pieces of the monopole fusible links 22 are required to be mounted, mounting the three-series fusible link 21 can meet the requirement.

Now, various cases where the monopole fusible link 22 is mounted in the cavity 27 will be described below.

In FIGS. 7A, 7B, 7C and 10A, when two pieces of the monopole fusible links 22 are mounted in the cavity 27, a non-mounted space 57 is created between these two monopole fusible links 22.

A reason why the non-mounted space 57 is created between the two monopole fusible links 22 is because the tabs 34 and the tab inserting holes 55 are arranged corresponding to the positions of the fuse terminals of the three-series fusible link 21, and at such positions that the tabs 34 and the tab inserting holes 55 do not interfere with the monopole housings 43, when the monopole fusible links 22 are mounted.

In FIGS. 8A, 8B, 8C and 10B, when a piece of the monopole fusible link 22 is mounted in the cavity 27, the two non-mounted spaces 57 are created respectively at both sides of the monopole fusible link 22.

The two non-mounted spaces 57 are created respectively at both sides of the monopole fusible link 22, in the same manner as the above described case in which the two monopole fusible links are mounted. It is also possible to select either one of the two mounting positions in FIGS. 7A, 7B, 7C and 10A. In this case, the non-mounted spaces 57 are created at a right side or a left side of the monopole fusible link 22.

Although not particularly illustrated in this embodiment, it is also possible to form a two-series fusible link and to mount the two-series fusible link in the cavity 27.

Speaking of other embodiments, in case where a four-series fusible link, for example, and a cavity corresponding to the four-series fusible link are formed, it is of course possible to mount the four-series fusible link in the cavity, and it is also possible to mount one or two pieces of the monopole fusible links including the non-mounted spaces.

Moreover, in case where a five-series fusible link, for example, and a cavity corresponding to the five-series fusible link are formed, it is of course possible to mount the five-series fusible link in the cavity, and it is also possible to mount one, two or three pieces of the monopole fusible links or the two-series fusible link including the non-mounted spaces.

As described hereinabove referring to FIGS. 1 to 10B, according to the invention, it is possible to achieve reduction of the size as compared with the prior art, by using the n-series fusible link (such as the three-series fusible link 21). Moreover, according to the invention, not only the n-series fusible link (such as the three-series fusible link 21) but also the monopole fusible link 22 can be mounted. Therefore, it is advantageous that versatility is enhanced as compared with the prior art.

Further, according to the invention, the cavity 27, the three-series fusible link 21, and the monopole fusible link 22 are respectively provided with a plurality of the guides 53, 42, 48. Therefore, it is advantageous that mounting performance is enhanced.

Further, according to the invention, the cavity 27 is provided with a pair of the cutouts 54. Therefore, it is advantageous that the fusible link can be easily picked up, when it is removed using the tool.

According to the invention, it is possible to achieve reduction in size as compared with the prior art, by using the n-series fusible link. Moreover, according to the invention, not only the n-series fusible link but also the monopole fusible link can be mounted. Therefore, it is advantageous that versatility is enhanced as compared with the prior art.

Further, according to the invention, it is possible to optimally arrange a plurality of the terminals as electrical connection parts for the n-series fusible link and the monopole fusible link.

Further, according to the invention, the cavity, the three-series fusible link, and the monopole fusible link are respectively provided with a plurality of the guides. Therefore, it is advantageous that mounting performance is enhanced.

Further, according to the invention, the cavity is provided with a pair of the cutouts, Therefore, it is advantageous that the fusible link can be easily picked up, when it is removed using the tool.

Further, according to the invention, the electrical junction box having better characteristics compared to that of the prior art can be provided.

It is apparent that various modifications can be made in the invention within a scope not deviating from the gist of the invention.

The present application is based on Japanese patent application No. 2011-117845 filed on May 26, 2011, and the contents of the patent application are incorporated herein by reference.

INDUSTRIAL APPLICABILITY

The present invention is useful for providing a fusible link mounting structure capable of enhancing versatility, while achieving reduction in size, and an electrical junction box employing the structure.

What is claimed is:

1. A fusible link mounting structure, comprising: an n-series fusible link (n is an integer of three or more) which is formed by providing n-pieces of fuse elements in series within a single common housing;

a plurality of monopole fusible links, each of which is formed by providing a piece of fuse element in a single monopole housing;

a cavity having a mounting space accommodating, mounted therein, the common housing in one instance and at least one of the monopole housings in a second instance, the cavity being formed according to a size of the common housing; and a plurality of terminals which are projected from a bottom of the cavity into the mounting space, or projected by passing through a bottom of the cavity into the mounting space, the terminals and the fuse elements of the n-series fusible link being electrically connected when the common housing is mounted in the cavity, and at least one of the terminals and the at least one fuse element of the at least one monopole fusible link being electrically connected when the at least one monopole housing is mounted in the cavity; wherein a total length of the mounting space is set to be shorter than a sum of lengths of n-pieces of the monopole housings, and wherein a pitch of the plurality of terminals in a lengthwise direction of the cavity is reduced such that n monopole fusible links could not be arranged adjacent to each other in the cavity sized according to the common housing of n-pieces of fuse elements in series in the n-series fusible link;

the number of the plurality of terminals which are connected to the n-series fusible link is identical to a number of terminals that would be individually connected to an equivalent number of monopole fusible links, and a plurality of the terminals are arranged corresponding to positions of a plurality of fuse terminals which are provided in the n-series fusible link, and also arranged at such positions that a plurality of the terminals do not interfere with the at least one monopole housing, when the at least one monopole fusible link is mounted in the cavity.

2. A fusible link mounting structure as claimed in claim 1, wherein a plurality of the terminals are arranged in such an arrangement that a non-mounted space is created at one side or at both sides of the at least one monopole housing, when the at least one monopole fusible link is mounted in the cavity.

3. A fusible link mounting structure as set forth in claim 1, wherein the cavity is provided with a plurality of guides extending in a mounting direction of the fusible link.

4. A fusible link mounting structure as set forth in claim 1, wherein the cavity is provided with at least a pair of cutouts which are formed by concaving an open edge of the cavity.

5. An electrical junction box characterized by employing the fusible link mounting structure as set forth in claim 1.

* * * * *